United States Patent [19]

Vickery

[11] Patent Number: 5,032,256

[45] Date of Patent: Jul. 16, 1991

[54] METHOD AND APPARATUS FOR AIR SEPARATION OF MATERIAL

[76] Inventor: James D. Vickery, 531 Lindsey Rd., Golden, Colo. 80401

[21] Appl. No.: 460,290

[22] Filed: Jan. 3, 1990

[51] Int. Cl.[5] ..... B07B 4/02

[52] U.S. Cl. ..... 209/135; 209/32; 209/146; 209/154

[58] Field of Search ..... 209/134, 135, 133, 146, 209/147, 154, 32

[56] References Cited

U.S. PATENT DOCUMENTS

| | | | |
|---|---|---|---|
| 10,272 | 11/1853 | Gritzner | 209/33 |
| 280,164 | 6/1983 | Hitchcock | 209/142 |
| 846,140 | 3/1907 | Rapp | 209/289 |
| 916,625 | 3/1909 | Stein | 209/33 |
| 1,428,093 | 9/1922 | Humpheries et al. | 209/147 |
| 1,834,981 | 12/1931 | Stebbins | 209/135 |
| 2,210,103 | 8/1940 | Stoner | 209/44.2 |
| 3,044,619 | 7/1962 | Knolle | 209/33 |
| 3,385,436 | 5/1968 | Murphy | 209/135 |
| 3,612,271 | 10/1971 | Behling | 209/644 |
| 3,799,339 | 3/1974 | Breitholtz et al. | 209/639 |
| 4,402,643 | 9/1983 | Lytton et al. | 209/160 |
| 4,519,896 | 5/1985 | Vickery | 209/44.1 |
| 4,759,840 | 7/1988 | McIntyre et al. | 209/135 |
| 4,950,388 | 8/1990 | Stafford | 209/135 |

FOREIGN PATENT DOCUMENTS

| | | | |
|---|---|---|---|
| 732033 | 5/1980 | U.S.S.R. | 209/134 |
| 1247106 | 7/1986 | U.S.S.R. | 209/135 |

OTHER PUBLICATIONS

Chapter 9, Taggart, *Handbook of Mineral Dressing*, John Wiley & Sons, New York (1964).

*Primary Examiner*—Donald T. Hajec

*Attorney, Agent, or Firm*—Bruce G. Klaas; William P. O'Meara

[57] ABSTRACT

The application disclosed a granular material classifying device comprising a horizontally disposed, transversely unrestricted wind tunnel, having an upstream end, a downstream end, a top end and a bottom end, for directing a horizontal airflow from the upstream end to the downstream end thereof; an air forcing assembly operatively mounted on the wind tunnel for inducing the horizontal airflow therethrough; a particle injection assembly operatively associated with the wind tunnel for free fallingly injecting a flow of granular particles to be classified into the horizontal airflow at an upstream, top end portion of the wind tunnel; and a bottom skirt assembly mounted at a bottom portion of the wind tunnel; the bottom skirt assembly defining at least one transversely unrestricted skirt cavity in fluid communication with the wind tunnel and having a downwardly and inwardly tapering cross sectional configuration adapted to provide a low velocity airflow interface between the wind tunnel horizontal airflow and the atmosphere; the at least one skrit cavity comprising a longitudinally extending slit in a bottom portion thereof adapted to enable discharge of granular particles therethrough. A granular material separating device and various methods of operating the classifying device and separating device are also disclosed.

32 Claims, 2 Drawing Sheets

METHOD AND APPARATUS FOR AIR SEPARATION OF MATERIAL

BACKGROUND OF THE INVENTION

The present invention relates generally to method and apparatus for separating particulate or granular material through use of an air stream.

Prior art air separating devices may be functionally grouped into two general categories: classifying devices which separate particulate material of approximately the same density based upon particle size; and sorting devices which separate granular mixtures containing different materials of different densities, e.g. materials such as gold and sand, into constituent components.

Air classifying devices are described in Stebbins, U.S. Pat. No. 1,834,981; Edwards, U.S. Pat. No. 3,948,764; Khag, U.S.S.R. Patent No. 732-033; each of which is hereby specifically incorporated by reference for all that is disclosed therein.

Air sorting devices are described in Stein, U.S. Pat. No. 916,625; Breiholtz et al., U.S. Pat. No. 3,799,339; and applicant's Patent. No. 4,519,896; each of which is hereby specifically incorporated by reference for all that is disclosed therein.

Some prior art devices might be considered combination sorting and classifying devices. One such device is described in Stoner, U.S. Pat. No. 2,210,103. The Stoner device separates material having constituent particles of different size and different density such as raisins and raisin stems.

Air sorting devices rely on weight differences between similarly sized particles for performing the sorting function and thus generally require prescreening of material before it is inserted into a separating airflow, see, e.g., Vickery, U.S. Pat. No. 4,519,896, column 3, lines 29–51, column 4, lines 21–68, and column 5, lines 1–6. In many commercial applications, such as the separation of gold from placer sand, the cost of prescreening the material to be separated is significantly greater than the cost associated with the air separation process. One reason for this substantial cost is that screening equipment is relatively expensive and requires frequent screen replacement and repair. Another reason for the substantial cost associated with screening is that a screening operation requires frequent operator intervention to dislodge near-size particles which become lodged in the screen mesh. Screen "plugging" problems become especially pronounced when the material to be screened contains a wide range of particle diameters. As a result of frequent operation shutdown for maintenance and repair, a screening operation also significantly limits the material through-put in airflow-type gold separating operations. It is one object of the present invention to significantly reduce or eliminate the need for material screening in material separating operations.

Applicant has also developed a number of refinements which improve the operation of a sorting device of the general type described in applicant's U.S. Pat. No. 4,519,896. Thus, it is an object of the present invention to provide a highly effective air sorting device.

Applicant has also discovered that an air separating device such as that described herein is extremely effective as a classifying device. Thus, it is an object of the present invention to provide a highly effective air classifying device.

SUMMARY OF THE INVENTION

The present invention may comprise a granular material classifying device comprising: (a) a horizontally disposed, transversely unrestricted wind tunnel means, having an upstream end, a downstream end, a top end and a bottom end, for directing a horizontal airflow from said upstream end to said downstream end thereof; (b) air forcing means operatively mounted on said wind tunnel means for inducing said horizontal airflow therethrough; (c) particle injection means operatively associated with said wind tunnel means for free fallingly injecting a flow of granular particles to be classified into said horizontal airflow at an upstream, top end portion of said wind tunnel means; and (d) bottom skirt means mounted at a bottom portion of said wind tunnel means; said bottom skirt means defining at least one transversely unrestricted skirt cavity in fluid communication with said wind tunnel means and having a downwardly and inwardly tapering cross sectional configuration adapted to provide a low velocity airflow interface between said wind tunnel horizontal airflow and the atmosphere; said at least one skirt cavity comprising a longitudinally extending slit in a bottom portion thereof adapted to enable discharge of granular particles therethrough.

The present invention may also comprise a method of classifying granular particles comprising: (a) free fallingly injecting said particles into a relatively constant velocity horizontal airflow; (b) subsequent to passage of said particles through said relatively constant velocity horizontal airflow, fallingly passing said particles through a transversely unrestricted, transition airflow zone having a horizontal airflow velocity of approximately zero in a lower portion thereof; and (c) subsequent to passage of said particles through said transition airflow zone, fallingly collecting said particles in a calm air region spaced apart from said transition airflow.

The present invention may also comprise a method for sorting granular material mixtures which include variously sized particles of a first type, for example gold, having a relatively high density and variously sized particles of a second type, for example sand, having a relatively low density comprising: (a) air separating the particles into coarsely separated batches by: (i) free fallingly injecting said particles into a relatively constant velocity, horizontal airflow; (ii) subsequent to passage of said particles through said relatively constant velocity horizontal airflow, fallingly passing said particles through a transversely unrestricted, transition airflow zone having a horizontal airflow velocity of approximately zero in a lower portion thereof; (iii) subsequent to passage of said particles through said transition airflow zone, fallingly collecting said particles in a calm air region spaced apart from said transition airflow; and (iv) segregating the fallingly collected particles into separate coarsely separated batches based upon the relative downstream location of discharge thereof from said transition airflow zone; (b) screeningly separating a selected one of said coarsely separated particle batches into a plurality of finely separated batches; and (c) air separatingly sorting a selected one of said finely separated batches into a plurality of sorted batches by: (i) free fallingly injecting particles from said selected finely separated batch into a relatively constant velocity, horizontal airflow; (ii) subsequent to passage of said particles through said relatively constant velocity horizontal airflow, fallingly passing said particles through a transversely unrestricted, transition airflow zone having a horizontal airflow velocity of approximately zero in a lower portion thereof; (iii) subsequent to passage of said particles through said transition airflow zone, fallingly collecting said particles in a calm air region spaced apart from said transition airflow; and (iv) segregating the fallingly collected particles into batches based upon the relative downstream location of discharge thereof from said transition airflow zone.

The present invention may also comprise a method for sorting granular material mixtures which include variously sized particles of a first type, for example gold, having a relatively high density and variously sized particles of a second type, for example sand, having a relatively low density comprising: (a) air separating the particles into coarsely separated batches by: (i) free fallingly injecting particles into a horizontal airflow of a first relatively constant velocity; (ii) subsequent to passage of said particles through said first constant velocity horizontal airflow, fallingly passing said particles through a transversely unrestricted, transition airflow zone having a horizontal airflow velocity of approximately zero in a lower portion thereof; (iii) subsequent to passage of said particles through said transition airflow zone, fallingly collecting said particles in a calm air region spaced apart from said transition airflow; and (iv) segregating the fallingly collected particles into separate coarsely separated batches based upon the relative downstream location of discharge thereof from said transition airflow zone; (b) air separating the particles in a selected one of said coarsely separated batches which is taken from a relatively downstream discharge location into finely separated batches by: (i) free fallingly injecting particles into a horizontal airflow of a second relatively constant velocity greater than said first velocity; (ii) subsequent to passage of said particles through said second constant velocity horizontal airflow, fallingly passing said particles through a transversely unrestricted, transition airflow zone having a horizontal airflow velocity of approximately zero in a lower portion thereof; (iii) subsequent to passage of said particles through said transition airflow zone, fallingly collecting said particles in a calm air region spaced apart from said transition airflow; and (iv) segregating the fallingly collected particles into separate finely separated batches based upon the relative downstream location of discharge thereof from said transition airflow zone.

The present invention may also comprise a method for converting raw coal into refined, powdered coal suitable for burning in a municipal utility power plant or the like, comprising: (a) beneficiating the raw coal so as to provide beneficiated coal in which substantially all coal particles have a diameter less than a predetermined beneficiate diameter; (b) free fallingly injecting said beneficiated particles into a relatively constant velocity horizontal airflow; (c) subsequent to passage of said beneficiated particles through said relatively constant velocity horizontal airflow, fallingly passing said beneficiated particles through a transversely unrestricted, transition airflow zone having a horizontal airflow velocity of approximately zero in a lower portion thereof; and (d) subsequent to passage of said beneficiated particles through said transition airflow zone, fallingly collecting said particles in a calm air region spaced apart from said transition airflow; (e) removing an upstream portion of said beneficiated particles collected in said calm air region; (f) retaining a downstream portion of said collected beneficiated particles for further processing; and (g) further processing the remaining beneficiated particles collected in said calm air region so as to provide said refined powdered coal.

The present invention may comprise a granular material sorting device comprising: (a) a horizontally disposed, transversely unrestricted wind tunnel means, having an upstream end, a downstream end, a top end and a bottom end, for directing a horizontal airflow from said upstream end to said downstream end thereof; (b) air forcing means operatively mounted on said wind tunnel means for inducing said horizontal airflow therethrough; (c) particle injection means operatively associated with said wind tunnel means for free fallingly injecting a flow of granular particles to be classified into said horizontal airflow at an upstream, top end portion of said wind tunnel means; and (d) bottom skirt means mounted at a bottom portion of said wind tunnel means; said bottom skirt means defining a plurality of laterally adjacently positioned skirt cavities in fluid communication with said wind tunnel means; each skirt cavity having a transversely unrestricted, downwardly and inwardly tapering cross sectional configuration adapted to provide a low velocity airflow interface between said wind tunnel horizontal airflow and the atmosphere; each skirt cavity comprising a longitudinally extending slit in a bottom portion thereof adapted to enable discharge of granular particles therethrough; wherein said at least one skirt cavity comprises a maximum width of less than about one foot.

The present invention may comprise a granular material sorting device comprising: (a) a horizontally disposed, transversely unrestricted wind tunnel means, having an upstream end, a downstream end, a top end and a bottom end, for directing a horizontal airflow from said upstream end to said downstream end thereof; (b) air forcing means operatively mounted on said wind tunnel means for inducing said horizontal airflow therethrough; (c) particle injection means operatively associated with said wind tunnel means for free fallingly injecting a flow of granular particles to be classified into said horizontal airflow at an upstream, top end portion of said wind tunnel means; and (d) bottom skirt means mounted at a bottom portion of said wind tunnel means; said bottom skirt means defining at least one skirt cavity in fluid communication with said wind tunnel means and having a transversely unrestricted, downwardly and inwardly tapering cross sectional configuration adapted to provide a low velocity airflow interface between said wind tunnel horizontal airflow and the atmosphere; said at least one skirt cavity comprising a longitudinally extending slit in a bottom portion thereof adapted to enable discharge of granular particles therethrough; wherein said longitudinally extending slit comprises an adjustable width slit.

The present invention may comprise a granular material sorting device comprising: (a) a horizontally disposed, transversely unrestricted wind tunnel means, having an upstream end, a downstream end, a top end and a bottom end, for directing a horizontal airflow from said upstream end to said downstream end thereof; (b) air forcing means operatively mounted on said wind tunnel means for inducing said horizontal airflow therethrough; (c) particle injection means operatively associated with said wind tunnel means for free fallingly injecting a flow of granular particles to be classified into said horizontal airflow at an upstream, top end portion of said wind tunnel means; (d) bottom skirt means mounted at a bottom portion of said wind tunnel means; said bottom skirt means defining at least one skirt cavity in fluid communication with said wind tunnel means and having a transversely unrestricted, downwardly and inwardly tapering cross sectional configuration adapted to provide a low velocity airflow interface between said wind tunnel horizontal airflow and the atmosphere; said at least one skirt cavity comprising a longitudinally extending slit in a bottom portion thereof adapted to enable discharge of granular particles therethrough; and (e) wherein said particle injection means comprises: (i) granular material supply means for providing a continuous supply of granular material; (ii) conveyor belt means for receiving said continuous supply of granular material from said supply means and for depositing said granular material in a scattering means; (iii) blade means for transversely spreading material deposited on said conveyor belt means and for limiting the height of material deposited on said conveyor belt means for providing a relatively uniform height, uniform width cascade of particles to said scattering means; and (iv) scattering means for scatteringly separating granular particles received therein prior to introduction thereof into said wind tunnel airflow.

BRIEF DESCRIPTION OF THE DRAWINGS

An illustrative and presently preferred embodiment of the invention is shown in the accompanying drawings in which.

DETAILED DESCRIPTION OF THE INVENTION

Granular Material Separating Device

In General

Figure 2:
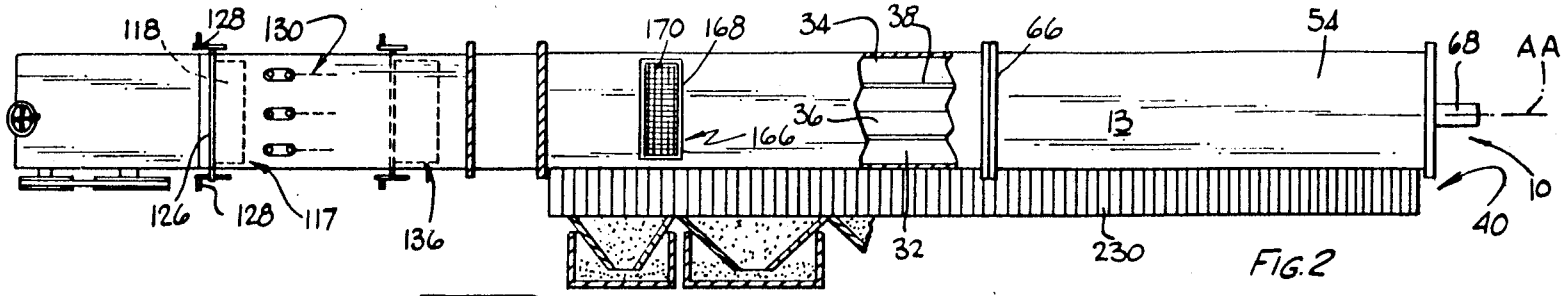
FIG. 2 is a partially cut-away top view of the separating device of FIG. 1.
Figure 1:
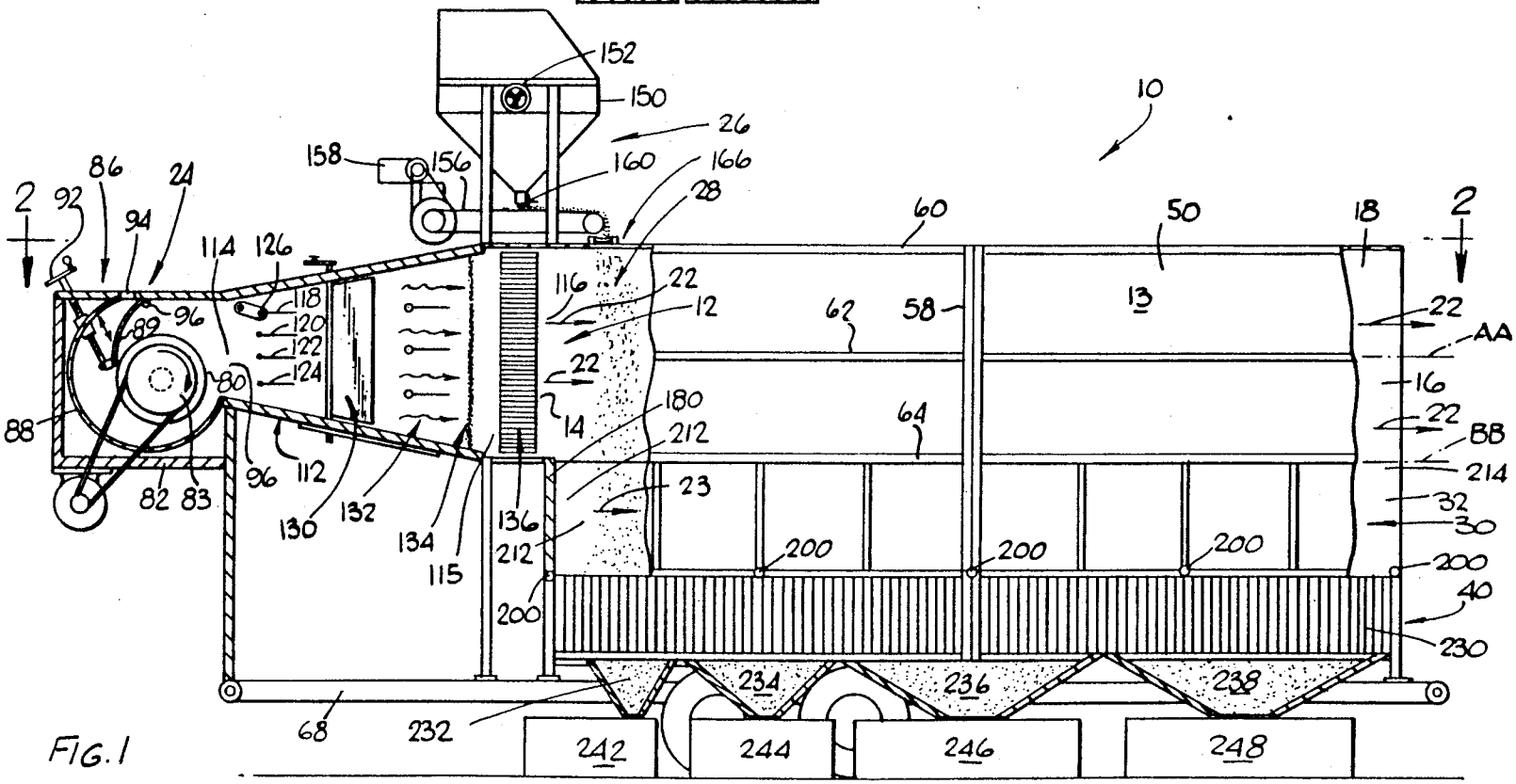
FIG. 1 is a partially cut-away side elevation view of a granular material separating device.
Figure 3:
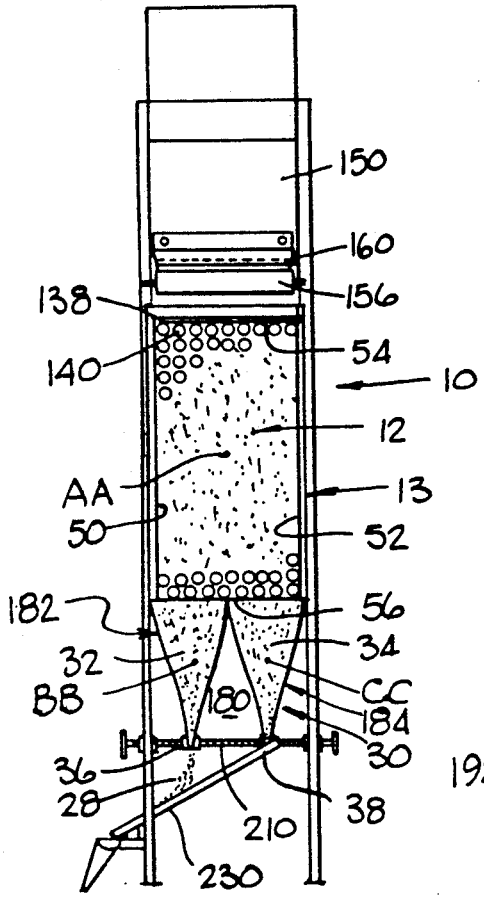
FIG. 3 is a downstream end view of the separating device of FIGS. 1 and 2.

FIGS. 1-3 are front, top, and downstream end views of a granular material separating device 10. The device includes a horizontally disposed, transversely unrestricted wind tunnel 12 having an open upstream end 14, an open downstream end 16, a closed top end 18, and an open bottom end 20. The wind tunnel 12 directs a horizontal airflow 22 from its upstream end to its downstream end parallel to its central longitudinal axis AA.

An air forcing assembly 24 is operably mounted on the wind tunnel for inducing the horizontal airflow 22 through the tunnel. A particle injection assembly 26 is provided for free fallingly injecting a flow of granular particles 28 which are to be separated into the horizontal airflow 22 at an upstream, top end portion of the wind tunnel 12. A bottom skirt assembly 30 is mounted at a bottom portion of the wind tunnel 12. The bottom skirt assembly defines at least one transversely unrestricted skirt cavity, e.g. cavities 32, 34, in fluid communication with the wind tunnel 12. Each cavity 32, 34 has a downwardly and inwardly tapering cross sectional configuration adapted to provide a low velocity airflow interface between the wind tunnel horizontal airflow 22 and the atmosphere. Each skirt cavity 32, 34 comprises a longitudinally extending slit 36, 38 in a bottom portion thereof adapted to enable discharge of granular particles 28 therethrough.

A collection assembly 40 is positioned beneath the skirt cavity slits 36, 38 for collecting granular particles falling therefrom. The particles may be collected in separate collection bins 242, 244, 246, 248.

In one exemplary use of the device 12 as an air classifying device, granular particles 28 of different sizes but of approximately the same density are injected into the horizontal airflow and are differentially acted on by the airflow. The particles fall from the airflow at a position downstream from the point of injection which corresponds to the size of the particle. Thus, particles of different sizes fall from the horizontal airflow at different positions corresponding to the particle size. The largest particles fall from the airflow at a relatively upstream position, the smallest particles fall from the airflow at a relatively downstream position.

Wind Tunnel

Horizontally disposed wind tunnel 12 is defined by a wind tunnel housing 13. The wind tunnel housing comprises a pair of vertical sidewalls 50, 52 which are sealingly connected at top edge portions thereof to a horizontal top wall 54. The housing sidewalls and top wall define a rectangular tunnel having an unrestricted bottom opening 56. The wind tunnel may have a width of 2.0 ft., a height of 4.0 ft., and a length of 16 ft.

The wind tunnel sidewalls and top wall may be constructed from sheet metal and may be reinforced by externally positioned, vertically and horizontally disposed brace members 58, 60, 62, 64, 66, etc.

The wind tunnel housing 13 may be mounted on a movable flatbed trailer assembly 68 to facilitate movement from one job site to another. A plurality air separating devices 10 may be mounted on the same trailer assembly.

Air Forcing Assembly

As illustrated in FIGS. 1 and 2, air forcing assembly 24 may be fixedly attached to the upstream end of wind tunnel housing 13 and may also be supported on flatbed trailer assembly 68. Air forcing assembly 24 may include an induction fan 80 which is mounted within a box-like fan housing 82 having a sidewall opening 83 therein to allow airflow into the fan. In the fan housing shown in FIG. 1, the right sidewall has been removed for illustrative purposes.

The fan may be driven by an electric motor, which in one preferred embodiment is a 7.5 hp motor. An airspeed control assembly 86 may be provided for controlling the airspeed produced in wind tunnel 12 by fan 80. The airspeed control assembly may include a first fixed arcuate plate 88 adapted to direct the airflow from the fan in a downstream direction. The airspeed control assembly may further include a second movable arcuate plate 89 which is hinged at 90 to a top wall of the fan housing 82 and which is radially inwardly and outwardly displaceable by a hand-crank 92 to selectively direct airflow from the fan into an upper housing opening 94 or a downstream housing opening 96. As more of the airflow is directed into upper housing opening 94, the airspeed within the wind tunnel is decreased. As airflow into opening 94 is decreased, wind tunnel airspeed is increased. Another manner of controlling airspeed is through use of a variable speed fan motor.

Air Straightening Assembly

An air straightening assembly 110 is positioned in fluid communication with air forcing assembly 24. The air straightening assembly 110 may comprise a generally trapezoidal air straightening housing 112 having an open upstream end 114 identical in shape to the downstream opening 96 of fan housing 82 and sealingly attached thereto. In one preferred embodiment, opening 114 is a rectangular opening having a height of 2.0 ft. and a width of 2.0 ft. Housing 112 comprises a downstream end portion 115 having a constant rectangular cross section identical to that of the wind tunnel. The downstream housing portion 115 may have an axial length of, e.g., 1.0 ft. The housing 112, including downstream end portion 115 thereof, is defined by first and second sidewalls and top and bottom walls which may be constructed from sheet metal or the like. The right sidewall has been removed in FIG. 1 for purposes of illustration. The air straightening housing comprises an open downstream end 116 which communicates directly with the open upstream end 14 of the wind tunnel.

The air straightening assembly 110 includes a first set of louvers 117 comprising four generally longitudinally and laterally disposed louvers 118, 120, 122, 124 which are each mounted on a laterally extending shaft 126, etc. The ends of each shaft extend through sidewall portions of housing 112 and are provided with handles 128, etc., which enables an operator to selectively move each louver to a desired position to control the vertical air velocity profile within tunnel 12. A second set of louvers 130 is constructed substantially identically to the first set of louvers except that the second set of louvers is generally vertically and longitudinally disposed and thus enables an operator to laterally deflect airflow within the housing 112. The second set of louvers is positioned downstream from the first set of louvers. A third set of louvers 132 of generally identical construction to the first set of louvers 17 is positioned downstream from the second set of louvers 130. The three sets of louvers 117, 130 and 132 enable an operator to precisely adjust the direction of airflow within housing portion 112 which, in turn, enables adjustment of the airflow within wind tunnel 12.

A pressure equalizing screen 134 extends across the entire cross section of air straightening housing 112 immediately upstream from the uniform cross section portion 115 thereof. Screen 134, in one preferred embodiment, has quarter-inch openings.

Positioned within air straightening housing 112 in downstream portion 115 is a multiple air passage "honeycomb" structure having a plurality of closely-spaced, longitudinally extending cylindrical, or alternatively polygonal, e.g. hexagonal, bores 138, 140, etc, FIGS. 1 and 3. Each cylindrical bore may have a length of 8 in. and a diameter of ⅜ in. The ratio of bore length to diameter is preferably never less than eight to one, and most preferably never less than twenty to one, for any size wind tunnel. There may be 20,000 uniformly-spaced conduits positioned within air straightening housing downstream portion 115. In one preferred embodiment, the honeycomb structure 136 comprises an integrally formed aluminum block with hexagonal holes formed therethrough.

Particle Injection Assembly

Figure 5:
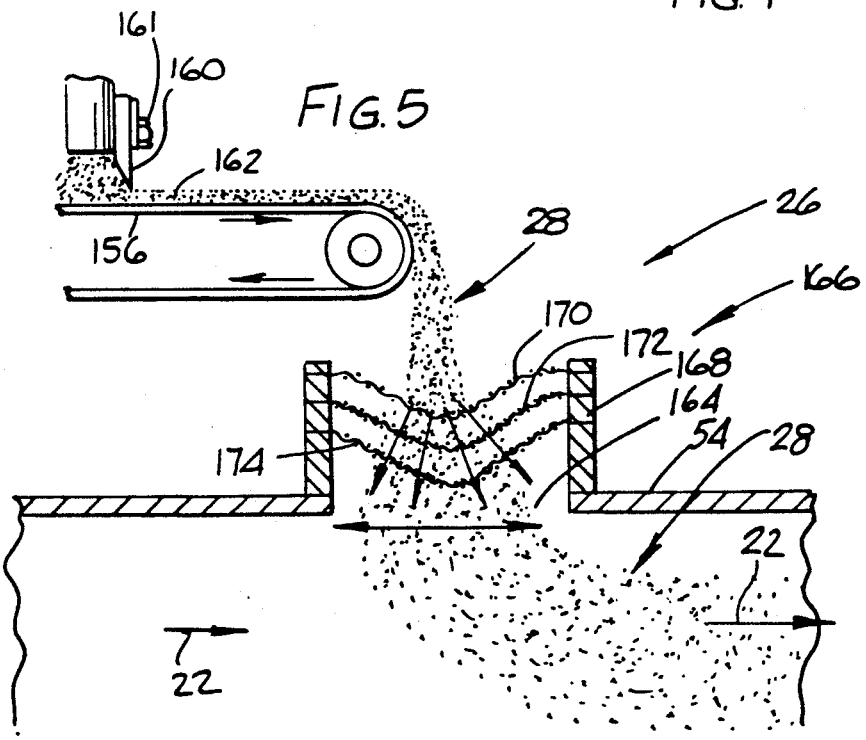
FIG. 5 is a partially cross sectional detail side elevation view of a particle injection assembly portion of the separating device of FIGS. 1-3.

As best illustrated by FIGS. 1, 3 and 5, particle injection assembly 26 comprises a conventional hopper 50 having a control knob 152 which controls the rate of particle discharge through hopper discharge opening 154. Discharge opening 154 extends laterally a distance approximately equal to the width of wind tunnel 12. The hopper discharge opening 154 is positioned above a conveyor belt 156 of approximately the same width as the wind tunnel 12. Conveyor belt 156 is driven by a selectively adjustable, variable speed motor 158. An adjustable-height "doctor blade" 160 which may be adjustably attached to a downstream edge of the hopper 150 as by bolt assembly 161 received through a vertical slot (not shown) in blade 160, selectively limits the height of the particle supply 162 on conveyor belt 156 enabling conveyor belt 156 to feed a uniform amount of granular particles 28 to an opening 164 in the wind tunnel top wall 54. A material scattering assembly 166 is positioned immediately above wall opening 164. The scattering assembly comprises an upstanding wall 168 positioned about the periphery of opening 164. The wall 168 supports first, second and third scattering screens 170, 172, 174 thereon which spreadingly scatter granular material 28 falling therethrough. The scattering screens may each comprise openings thereon that are four times as large as the largest particle which is to be processed. The screens may be positioned approximately 0.5 in. apart.

Bottom Skirt Assembly

Figure 4:
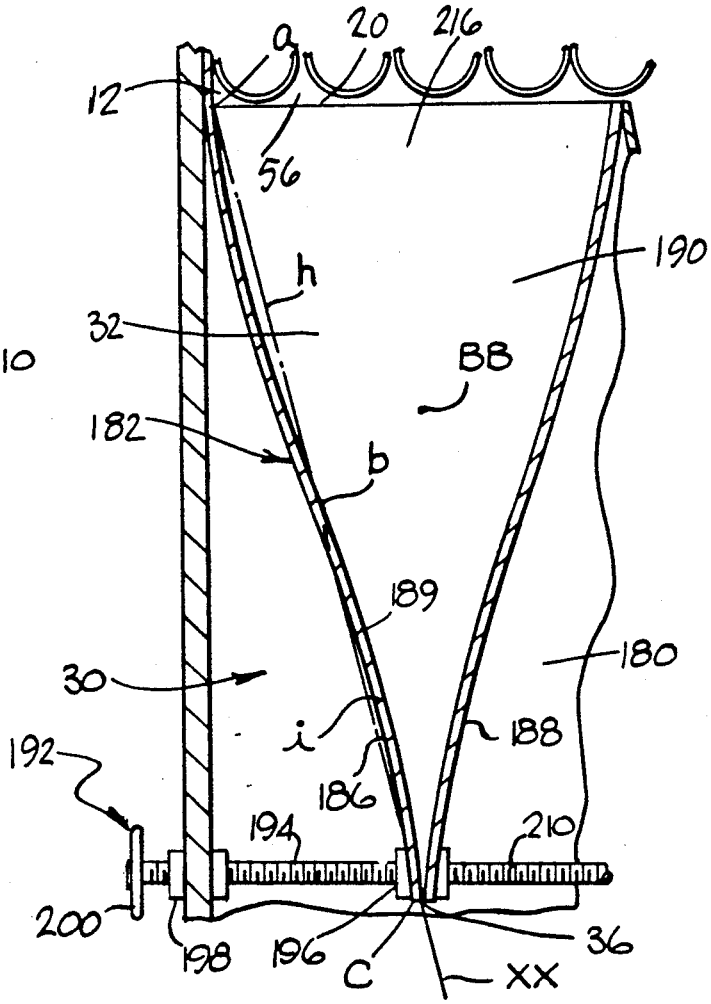
FIG. 4 is a detail view of a portion of a skirt assembly portion of the separating device shown in FIG. 3.

As illustrated in FIGS. 3 and 4, bottom skirt assembly 30 comprises an upstream, transversely disposed, vertical end plate 180 which is positioned directly below the upstream end 14 of wind tunnel 12 and which seals the upstream end portion of skirt assembly cavities 32, 34. Skirt cavities 32 and 34 are defined by first and second skirt portions 182 and 184. Each of the skirt portions 182, 184 comprises a pair of downwardly and inwardly extending sidewalls 186, 188. Each sidewall has a generally sinewave-shaped interior surface 189 arranged about an axis XX which intersects the interior surface 189 at points a, b and c at the top end, bottom end, and middle, respectively, of surface 189. The length of ab is equal to the length of bc and may be 12.25 in. Line ab has a midpoint at h and line bc has a midpoint at i. The distance of points h and i to interior surface 189 may be equal and may be between 0.5 and 1.0 in. and most preferably about 0.75 in. for the exemplary embodiment described herein. Sidewalls 186 and 188 define a skirt cavity cross section having a top width which is preferably less than 1.5 ft. and most preferably about 1 ft. The height-to-width ratio of the skirt cavity is preferably more than about 1.5 to 1 and most preferably is more than about 2 to 1. In one embodiment, the skirt cavity height is equal to 2 ft. The lower end portions of sidewalls 186, 188 define a longitudinally extending slit 36 which preferably has a width greater than three times the width of the largest particle in a particular batch of particles which is being processed. Such a slit width is the smallest width which will enable free fall of particles through the slit without significant jamming. A convenient slit width size may be 3/16 in.

A slit width adjustment assembly 192 may be provided to adjust the width of the slit to accommodate air separation of particles of different maximum size. The slit width adjustment assembly may comprise a screw 194 which is journaled to a plate 196 which is, in turn, fixedly attached to a lower end of one skirt sidewall 186. The screw is received in a threaded bushing 198 which is fixedly mounted in one of the vertical brace members. A knob 200 may be provided at the terminal end of screw 194 to enable hand-rotation of screw 194 for selectively laterally moving the lower end of sidewall 186 to adjust the width of slit 186. Slit width adjustment assemblies identical in construction to that shown at 192 may be provided at preselected intervals, e.g. every 2 ft., along the length of each skirt portion 182, 184. A spacer 210 may be welded between adjacent sidewalls of adjacent skirt portions so as to provide support at the lower end of each interiorly positioned wall 188.

Each skirt cavity is transversely unrestricted and has a central longitudinal axis BB, CC, etc., positioned parallel to the central longitudinal axis AA of wind tunnel 12. Each skirt cavity comprises a closed upstream portion 212 and an open downstream end portion 214 and an open top end 216. The open top end 216 of each skirt portion communicates directly with the wind tunnel lower opening 20. It has been discovered that, by restricting the size of the top end opening to a lateral dimension of less than about 1 ft. and a height-to-width ratio of more than about 2 to 1, the performance of the wind tunnel is improved. Thus, with relatively wide wind tunnels, it may be necessary to provide several adjacently positioned skirt portions.

It has been determined experimentally that by maintaining the bottom slit opening 36 at a relatively small dimension, e.g. preferably less than 3/16 in., a transition zone is provided between the relatively constant velocity airflow in the wind tunnel 12 and the zero velocity airflow in the outside atmosphere. Such a transition zone has a horizontal velocity at its upper portion approximately equal to the horizontal velocity of the wind tunnel and has progressively lower velocities from the top to the bottom of the skirt cavity with a velocity of approximately zero at the bottom slit opening 36. Thus, an orderly transition zone is provided which prevents the discriminating effect of the horizontal airflow in the wind tunnel from being destroyed by random or non-orderly airflows at a wind tunnel/atmosphere interface.

Collection Assembly

Collection assembly 40 may comprise a longitudinally and diagonally disposed plate 230 positioned directly below the slits 36, 38 in the bottom skirt assembly 30. The plate may be a corrugated metal plate which is sloped downwardly at an angle of approximately 45 from the horizontal. A plurality of chutes 232, 234, 236, 238 may be positioned in association with predetermined downstream portions of the lower edge of plate 230 so as to group together all particles falling from the wind tunnel at each predetermined downstream location. Particles received within the various chutes may be collected in separate collections containers 42, 244, 246, 248.

Classification

The above-described granular material separating device 10 may be used as a classifying device for separating granular material particles of approximately the same density but of different particle sizes on the basis of particle size.

The granular material to be separated, for example silica sand particles having sizes between 12 mesh and 200 mesh, is deposited into hopper 150. The hopper feed control knob and the conveyor belt speed are adjusted to provide an appropriate feed rate, for example 2.0 cubic feet per minute. The particle injection assembly feeds the granular material into the scattering assembly 166 which scatters the granular particles 28 as they enter horizontal airstream 22. An airstream velocity suited for the particular classification application is preselected by an operator. (The air velocity control means, e.g. crank 92, may be precalibrated with the aid of a venturi or other air velocity meter [not shown] positioned at a selected point in the airstream, e.g. near the downstream end 16. The air straightening louver sets 117, 130, 136 may be preadjusted by an operator to provide a uniform horizontal airflow. To facilitate such air straightening adjustment, a portion of the wind tunnel sidewall and top wall may be constructed from a transparent material such as transparent plastic and smoke or other visible media may be blown through the wind tunnel.)

The airspeed which is selected will be dependent upon the particular results sought by the operator. For example, if it is desired to collect and retain only relatively large particles, the airspeed may be selected such that nearly all particles below a predetermined particle size will be blown out the downstream end of the wind tunnel. On the other hand, if all particles are to be retained and separated into batches based on particle size, then a lower velocity is selected which enables nearly all particles to fall from the wind tunnel along the length thereof. This selected speed may be determined by the operator empirically by blowing several test runs of material at different air velocities. As a general rule, the denser and larger the particles to be classified, the greater the tunnel air velocity must be.

Particles falling from the scattering assembly 166 are initially exposed to the constant velocity airflow within the wind tunnel. This airflow carries particles downstream for a distance which is dependent on particle size. Smaller particles are carried downstream farther than larger particles. After falling through the wind tunnel airflow 22, the particles fall through a transition flow in the skirt assembly cavities. This transition airflow varies in horizontal velocity from a velocity approximately equal to that in the wind tunnel 12 at an upper end 216 of the skirt cavity, e.g. 32, to a velocity of about zero at the skirt cavity bottom slit 36. The low velocity transition allows aprticles to fall more vertically which helps to prevent skipping, bouncing, and undesirable mixing of particles.

The particles then fall through slit 36 onto plate 230. The particles may be grouped into selected size ranges through positioning of collection chutes, e.g. 232, 234, etc., of selected widths at selected locations along the length of plate 230. If further classification of particles in any collected batch, e.g. batch 242, is desired, such further classification may be accomplished by again injecting these particles into the wind tunnel airflow but with the wind tunnel operating at a higher air velocity than in the original air classification operation. This reblowing operation may be repeated again and again at successively higher air velocities for succeeding collections of particles to even more finely separate the particles. However, a limiting factor in use of such reblowing cycles is the length of the wind tunnel. For some smaller particle size ranges, the increase in air velocity needed for finer classification of particles may blow some or all of the particles to be classified out the downstream end of the wind tunnel. Thus, when fine gradation over a wide range of particle sizes is required, especially if the particles are relatively low density particles, a very long wind tunnel may be required.

The granular material separating device 10 may also be used to improve the efficiency of a conventional gold floatation separating system. In a conventional gold floatation separating system, ore containing gold, rock and other impurities is ground to a preselected small mesh size, e.g. 400 mesh, and is then placed in a high density liquid, e.g. chemicals or reagents, floatation bath. The relatively heavy gold sinks and is collected at the bottom of the bath while the lighter rock and other impurities float on the surface of the bath and are removed. The method by which the ore is ground to the relatively small particle size is by grinding the ore in a series of progressively-smaller-size grinding devices. A certain inefficiency in such a grinding process results from the fact that fine particles which are already sufficiently small for floatation purposes are continually reground in each successively finer regrinding operation. The present invention may be used to improve this process by continuing the coarser grinding operations for relatively longer periods of time and thereafter blowing resulting particles having a size below the predetermined size required for floatation processing from the resulting particle mixture by inserting the resulting particle mixture into the wind tunnel and thereafter removing all particles falling beyond a predetermined downstream tunnel position for immediate floatation processing. The mixture remaining after the blowing removal of the small particles may then be further grindingly processed without wasting energy associated with grinding of the already sufficiently small particles. This blowing process may be repeated after each or after selected ones of the various grinding stages to further increase the efficiency of the process. The blowing removal of small particles may even eliminate the need for some of the intermediate grinding stages.

Sorting

The above-described granular material separating device 10 may also be used as a sorting device for sorting material mixtures which include variously sized particles of a first type, for example gold, having a relatively high density and variously sized particles of a second type, for example sand, having a relatively low density. The device is used to sort such mixtures into constituent components, e.g. gold and sand.

One method of using a wind tunnel apparatus in a granular material sorting operation is described in applicant's U.S. Pat. No. 4,519,896, which is incorporated by reference into the present application. That patent described prescreening of a granular material mixture into sizingly segregated batches prior to injection of the material mixture into the wind tunnel. A problem with such prescreening of material mixtures is that it represents a significant expense both in terms of equipment and labor. The methods of use of the device 10 which are described below substantially reduce or eliminate the cost associated with material screening in a sorting operation.

One exemplary use of a separating device 10 such as specifically described above, except having a tunnel length of 32 ft. rather than 16 ft., was made by the applicant to separate a mixture of silica sand particles and iron ore particles. The mixture contained approximately 1 part iron ore to 4 parts sand by volume. The particles of each constituent component ranged in size from 12 mesh to 400 mesh and constituted an approximately even distribution of particle sizes.

Initially, the entire unscreened mixture was blown in the separating device 10. The material was injected at a feed rate of approximately one cubic foot per minute and was blown at a wind tunnel horizontal airspeed of 2 meters per second. A high concentration of iron ore (about 98% iron ore) fell from the device 10 at a downstream location more than 3.0 ft. upstream from the point of injection. The particles in this region were mostly between 12 and 25 mesh in size. The material in this upstream location was removed and screened in an 18 mesh screen. All particles smaller than 18 mesh were retained and particles larger than 18 mesh were discarded.

The material from the first blow falling out farther than 3.0 ft. downstream from the injection point was then collected and reblown in the device 10 at a horizontal air velocity of 3 meters per second. A concentrate which was approximately 80% iron ore was found to fall out in a region less than 5.5 ft. downstream from the injection point. This material ranged mostly in particle size from 25 mesh to 50 mesh. This material was screened with a 38 mesh screen. Particles smaller than 38 mesh were retained and the rest were discarded.

The material from the second blow falling out more than 5.5 ft. downstream from the injection point was collected and reblown in the device 10 at a horizontal air velocity of 4 meters per second. A concentrate of approximately 72% iron ore fell from the device 10 in a region less than 13 ft. downstream from the injection point. These particles generally ranged in size from 50 mesh to 100 mesh. The particles from this upstream location were removed and screened with an 80 mesh screen. Particles smaller than 80 mesh were retained and the rest was discarded.

The material from the third blow lying more than 13 ft. downstream from the injection point was collected and reblown in the device 10 at a horizontal air velocity of 5 meters per second. An iron ore concentrate of approximately 80% was found to fall from the tunnel between the injection point and the end of the tunnel (32 ft. downstream). This material ranged in particle size from about 100 mesh to about 200 mesh. Applicant would ideally have used a 150 mesh screen to screen these particles, retaining the particles less than 150 mesh in size. However, no such screen was available at the test site and thus half of the particles were screened with a 100 mesh screen and half of the particles were screened with a 200 mesh screen. In each case, the particles passing through the screen were retained.

Applicant recovered approximately 79% of the iron ore which was originally contained in the mixture using the above-described method. The recovered material was approximately 95% pure iron ore.

The above-described process had substantially less screening time than the screening time which would be required in a prescreening blowing operation such as described in U.S. Pat. No. 4,519,896 due to the fact that each batch of material being screened in the above-described method contained particles which were relatively close to the same size before the screening operation began. Thus, "plugging" and other problems associated with screening of large volumes of material with widely different particle sizes was considerably reduced.

In a process similar to that described above material to be sorted is initially blown in the device 10 to coarsely classify the particles. Then selected groupings of particles falling at approximately the same downstream location are individually screened to obtain a preselected ratio of minimum to maximum particle diameters. Finally, each screened group of particles is individually blown at a selected velocity. In the final blow of each screened grouping, heavy particles, e.g. gold, fall out upstream and light particles, e.g. sand, falls out relatively downstream. The particles thus segregate and are separately collected.

A method similar to that described above may be used in the processing of coal. Large commercial coal-burning facilities such as municipal power plants and the like require coal to be provided in a purified powdered form for burning. The normal industrial process for obtaining purified powdered coal from raw coal is to initially rough-crush or "beneficiate" the coal down to a particle size on the order of ¼ in. and smaller. This beneficiated coal is then water-processed to remove relatively high density rock from the relatively low density coal. The purified coal thus provided is then as dried by any number of conventional methods including older rotary kiln dryers, fluid bed dryers, and centrifugal dryers. Finally, the dried coal is further crushed to a powder size e.g. 300 mesh, to complete the process.

In the improved method utilizing the separating device 10 of the present invention, coal is initially crushed or beneficiated to a particle size of 6 mesh or smaller. The beneficiated coal is then blown in an air separating device such as that described above or a scaled-up version thereof. During such blowing, heavy impurities such as rock fall out upstream and coal, which has a specific gravity of approximately 1.2, falls out at a downstream location. All of the upstream material which is predominantly impurities is then removed and the remaining material is crushed down to powder size, e.g. 300 mesh or smaller. Thus, this method eliminates the relatively expensive steps of water-separation and drying of the coal.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A granular material classifying device comprising:

a) a horizontally disposed, transversely unrestricted wind tunnel means, having an upstream end, a downstream end, a top end and a bottom end, for directing a horizontal airflow from said upstream end to said downstream end thereof;

b) air forcing means operatively mounted on said wind tunnel means for inducing said horizontal airflow therethrough;

c) particle injection means operatively associated with said wind tunnel means for free fallingly injecting a flow of granular particles to be classified into said horizontal airflow at an upstream, top end portion of said wind tunnel means; and d) bottom skirt means mounted at a bottom portion of said wind tunnel means; said bottom skirt means defining at least one transversely unrestricted skirt cavity in fluid communication with said wind tunnel means and having a downwardly and inwardly tapering cross sectional configuration adapted to provide a low velocity airflow interface between said wind tunnel horizontal airflow and the atmosphere; said at least one skirt cavity comprising a longitudinally extending slit in a bottom portion thereof extending substantially the entire length of said wind tunnel means and having at least one open end and being adapted to enable discharge of granular particles therethrough.

2. The invention of claim 1, said wind tunnel means having a constant rectangular cross section from upstream end to downstream end thereof.

3. The invention of claim 1 wherein said at least one skirt cavity comprises a maximum horizontal dimension, measured transversely of said wind tunnel airflow, of less than about one foot.

4. The invention of claim 1 wherein said skirt means comprises a plurality of substantially identically shaped skirt cavities.

5. The invention of claim 1 wherein said skirt means comprises a sidewall having a generally sinewave-shaped configuration.

6. The invention of claim 1 wherein the ratio of the maximum vertical dimension to the maximum transverse dimension of said at least one skirt cavity is more than about two to one.

7. The invention of claim 1 wherein:

a) said wind tunnel means has a constant rectangular cross section from upstream end to downstream end thereof;

b) said at least one skirt cavity comprises a maximum horizontal dimension, measured transversely of said wind tunnel airflow, of less than about one foot;

c) said skirt means comprises a sidewall having a generally sinewave-shaped configuration; and d) the ratio of the maximum vertical dimension to the maximum transverse dimension of said at least one skirt cavity is more than about two to one.

8. The invention of claim 7 wherein said skirt means comprises a plurality of substantially identically shaped skirt cavities.

9. The invention of claim 8, said wind tunnel means comprising a height-to-width ratio of approximately two to one.

10. The invention of claim 9, said wind tunnel comprising a length of at least 16 feet.

11. The invention of claim 10 further comprising air straightening means for producing a uniform horizontal airflow in said wind tunnel means.

12. The invention of claim 11 wherein said air straightening means comprises a plurality of closely spaced cylindrical orifices extending longitudinally of said wind tunnel means.

13. The invention of claim 12, said air straightening means further comprising adjustable baffle plates positioned upstream of said cylindrical orifices.

14. The invention of claim 13 wherein each of said cylindrical orifices comprises a length-to-diameter ratio of at least eight to one.

15. The invention of claim 14 wherein the diameter of each of said cylindrical orifices is between ⅜ inch and ½ inch.

16. The invention of claim 11 further comprising airspeed varying means for selectively varying the speed of said horizontal airflow through said wind tunnel means.

17. The invention of claim 1 wherein said particle injection means comprises:

a) granular material supply means for providing a continuous supply of granular material;

b) conveyor belt means for receiving said continuous supply of granular material from said supply means and for depositing said granular material in a scattering means;

c) blade means for transversely spreading material deposited on said conveyor belt means and for limiting the height of material deposited on said conveyor belt means for providing a relatively uniform height, uniform width cascade of particles to said scattering means; and d) scattering means for scatteringly separating granular particles received therein prior to introduction thereof into said wind tunnel airflow.

18. The invention of claim 1 further comprising collection means for groupingly collecting classified particles falling from said skirt means slit.

19. The invention of claim 1, said longitudinally extending slit comprising an adjustable width slit.

20. The invention of claim 16 wherein:

said particle injection means comprises:

a) granular material supply means for providing a continuous supply of granular material;

b) conveyor belt means for receiving said continuous supply of granular material from said supply means and for depositing said granular material in a scattering means;

c) blade means for transversely spreading material deposited on said conveyor belt means and for limiting the height of material deposited on said conveyor belt means for providing a relatively uniform height, uniform width flow of particles to said scattering means; and d) scattering means for scatteringly separating granular particles received therein prior to introduction of said particles into said wind tunnel airflow;

and further comprising collection means for groupingly collecting classified particles falling from said skirt means slit;

and wherein said longitudinally extending slit comprising an adjustable width slit.

21. A granular material classifying device comprising:

a) a horizontally disposed, transversely unrestricted wind tunnel means, having an upstream end, a downstream end, a top end and a bottom end, for directing a horizontal airflow from said upstream end to said downstream end thereof;

b) air forcing means operatively mounted on said wind tunnel means for inducing said horizontal airflow therethrough;

c) particle injection means operatively associated with said wind tunnel means for free fallingly injecting a flow of granular particles to be classified into said horizontal airflow at an upstream, top end portion of said wind tunnel means; and d) bottom skirt means mounted at a bottom portion of said wind tunnel means; said bottom skirt means defining at least one transversely unrestricted skirt cavity in fluid communication with said wind tunnel means and having a downwardly and inwardly tapering cross sectional configuration adapted to provide a low velocity airflow interface between said wind tunnel horizontal airflow and the atmosphere; said at least one skirt cavity comprising a longitudinally extending slit in a bottom portion thereof adapted to enable discharge of granular particles therethrough; wherein said skirt means comprises a plurality of substantially identically shaped skirt cavities.

22. A granular material classifying device comprising:

a) a horizontally disposed, transversely unrestricted wind tunnel means, having an upstream end, a downstream end, a top end and a bottom end, for directing a horizontal airflow from said upstream end to said downstream end thereof;

b) air forcing means operatively mounted on said wind tunnel means for inducing said horizontal airflow therethrough;

c) particle injection means operatively associated with said wind tunnel means for free fallingly injecting a flow of granular particles to be classified into said horizontal airflow at an upstream, top end portion of said wind tunnel means;

d) bottom skirt means mounted at a bottom portion of said wind tunnel means; said bottom skirt means defining at least one transversely unrestricted skirt cavity in fluid communication with said wind tunnel means and having a downwardly and inwardly tapering cross sectional configuration adapted to provide a low velocity airflow interface between said wind tunnel horizontal airflow and the atmosphere; said at least one skirt cavity comprising a longitudinally extending slit in a bottom portion thereof adapted to enable discharge of granular particles therethrough;

e) and wherein:

i) said wind tunnel means has a constant rectangular cross section from upstream end to downstream end thereof;

ii) said at least one skirt cavity comprises a maximum horizontal dimension, measured transversely of said wind tunnel airflow, of less than about one foot;

iii) said skirt means comprises a sidewall having a generally sinewave-shaped configuration;

iv) the ratio of the maximum vertical dimension to the maximum transverse dimension of said at least one skirt cavity is more than about two to one; and v) said skirt means comprises a plurality of substantially identically shaped skirt cavities.

23. The invention of claim 22, said wind tunnel means comprising a height-to-width ratio of approximately two to one.

24. The invention of claim 23, said wind tunnel comprising a length of at least 16 feet.

25. The invention of claim 24 further comprising air straightening means for producing a uniform horizontal airflow in said wind tunnel means.

26. The invention of claim 25 wherein aid air straightening means comprises a plurality of closely spaced cylindrical orifices extending longitudinally of said wind tunnel means.

27. The invention of claim 26, said air straightening means further comprising adjustable baffle plates positioned upstream of said cylindrical orifices.

28. The invention of claim 27 wherein each of said cylindrical orifices comprises a length-to-diameter ratio of at least eight to one.

29. The invention of claim 28 wherein the diameter of each of said cylindrical orifices is between $\frac{3}{8}$ inch and $\frac{1}{2}$ inch.

30. The invention of claim 25 further comprising airspeed varying means for selectively varying the speed of said horizontal airflow through said wind tunnel means.

31. The invention of claim 30 wherein:

said particle injection means comprises:

a) granular material supply means for providing a continuous supply of granular material;

b) conveyor belt means for receiving said continuous supply of granular material from said supply means and for depositing said granular material in a scattering means;

c) blade means for transversely spreading material deposited on said conveyor belt means and for limiting the height of material deposited on said conveyor belt means for providing a relatively uniform height, uniform width flow of particles to said scattering means; and d) scattering means for scatteringly separating granular particles received therein prior to introduction of said particles into said wind tunnel airflow;

and further comprising collection means for groupingly collecting classified particles falling from said skirt means slit;

and wherein said longitudinally extending slit comprising an adjustable width slit.

32. A granular material classifying device comprising:

a) a horizontally disposed, transversely unrestricted wind tunnel means, having an upstream end, a downstream end, a top end and a bottom end, for directing a horizontal airflow from said upstream end to said downstream end thereof;

b) air forcing means operatively mounted on said wind tunnel means for inducing said horizontal airflow therethrough;

c) particle injection means operatively associated with said wind tunnel means for free fallingly injecting a flow of granular particles to be classified into said horizontal airflow at an upstream, top end portion of said wind tunnel means; and d) bottom skirt means mounted at a bottom portion of said wind tunnel means; said bottom skirt means defining at least one transversely unrestricted skirt cavity in fluid communication with said wind tunnel means and having a downwardly and inwardly tapering cross sectional configuration adapted to provide a low velocity airflow interface between said wind tunnel horizontal airflow and the atmosphere; said at least one skirt cavity comprising a longitudinally extending slit in a bottom portion thereof adapted to enable discharge of granular particles therethrough; said longitudinally extending slit comprising an adjustable width slit.

* * * * *